US011548111B2

(12) United States Patent
Balsells Mercadé

(10) Patent No.: US 11,548,111 B2
(45) Date of Patent: Jan. 10, 2023

(54) SHARPENING SYSTEM FOR CUTTER BLADES FOR CUTTING FLEXIBLE MATERIALS IN AUTOMATIC CUTTING MACHINES

(71) Applicant: OPEN MIND VENTURES, S.L.U., Igualada (ES)

(72) Inventor: Antoni Balsells Mercadé, Igualada (ES)

(73) Assignee: OPEN MIND VENTURES, S.L.U., Igualada (ES)

( * ) Notice: Subject to any disclaimer, the term of this patent is extended or adjusted under 35 U.S.C. 154(b) by 424 days.

(21) Appl. No.: 16/787,463

(22) Filed: Feb. 11, 2020

(65) Prior Publication Data

US 2020/0254578 A1 Aug. 13, 2020

(51) Int. Cl.
*B24B 3/36* (2006.01)

(52) U.S. Cl.
CPC ..... *B24B 3/368* (2013.01)

(58) Field of Classification Search
CPC ..... B24B 3/368; B24B 3/363; B24B 3/361; B24B 3/36; B26D 7/088; B26D 7/12; D06H 7/00; B26F 1/382
USPC ..... 451/420
See application file for complete search history.

(56) References Cited

U.S. PATENT DOCUMENTS 2,099,280 A * 11/1937 Shaff ..... B24B 23/026 418/94
6,092,450 A * 7/2000 Dueck ..... B65H 35/08 83/508
7,112,124 B1 * 9/2006 Naples ..... B24B 3/60 451/367
2002/0173251 A1 * 11/2002 Cobbler ..... B24B 3/36 451/213
2011/0081838 A1 * 4/2011 Bagley ..... B24D 15/06 451/555
2015/0261137 A1 * 9/2015 Mitani ..... G03G 15/161 399/101

* cited by examiner

*Primary Examiner* — Giovanni Astacio-Oquendo
(74) *Attorney, Agent, or Firm* — Perry + Currier Inc.

(57) ABSTRACT

The sharpening system for cutter blades for cutting flexible materials in automatic cutting machines comprises at least one sharpening element, and it also comprises a first sharpening module that includes at least one first sharpening element, and a second sharpening module that includes at least one second sharpening element.

It provides a sharpening system that offers an integral and simple solution to current sharpening systems by incorporating an active sharpening system in the guide plate, either in the rotary area or on the outside, or symmetrically in the upper part of the lower body of the cutting head, interchangeably.

14 Claims, 2 Drawing Sheets

SHARPENING SYSTEM FOR CUTTER BLADES FOR CUTTING FLEXIBLE MATERIALS IN AUTOMATIC CUTTING MACHINES

The present invention relates to a sharpening system for cutter blades for cutting flexible materials in automatic cutting machines, which makes it possible to provide an integral and simple solution to current sharpening systems by incorporating an active sharpening system in the lower guide plate, or symmetrically in the upper part of the lower body of the cutting head, interchangeably.

BACKGROUND OF THE INVENTION

Computer numerical control cutting machines for cutting flexible multi-layer or single-layer materials need to sharpen the blades frequently during the execution of their functions.

The flexible materials to be cut, such as textile materials, composites, etc., require very sharp blades, given that, otherwise, they drag the material, leading to unwanted results.

For this reason, unlike other types of computer numerical control cutting machines, they need to incorporate sharpening systems designed to ensure that this sharpening function is executed frequently, such as from minutes to seconds, with variations based on the hardness, abrasion resistance, softness, melting temperature, etc. of each material when cut. This sharpening time can vary, and during this time the machine is not cutting anything, thereby reducing its productivity.

These computer numerical control cutting machines comprise a cutting head formed by an upper body and a lower body. The upper body of said cutting head houses the vibration module of the blade, the actuators, etc., while the lower body of said cutting head houses the rotary lower guide plate, the sharpening system (interchangeably on the lower or upper part of said lower body), etc.

The vibration module of the blade is mounted on a vertical mobile system that makes it possible to vary the height of the blade such that, while cutting, the blade is situated in a lower position inside the material to be cut, bringing the blade closer to the lower guide plate which presses against the materials that are being cut. Said rotary lower guide plate has a variable height depending on the thickness of the material to be cut. The vibration module is disposed on the upper body of the cutting head.

The function of the lower body is to guide the blade vertically in the direction of vibration, and it also accompanies and guides the blade in rotations from 0° to 360°, which are necessary to orient the blade in the direction of the profiles ordered by the computer numerical control system.

Said lower body guides and accompanies the blade, both vertically and in the rotations, but said movements are generated in the upper part (the upper part is the location of the actuators, which can be motors, pistons, etc., that generate the movements of the blade).

This lower part consists of a pressure rotary guide plate having a vertical movement that is independent from the movement of the blade. The blade passes through this rotary guide plate and enters the cutting area, where the flexible material to be cut is situated, free from attachments or guides.

The rotary guide plate rests with greater or lesser force on the material to be cut, which may or may not be compressed. The rotary guide plate is a crucial element, as it is the last mechanical assembly that accompanies and keeps the blade rigid before it penetrates the material to be cut, forming a true line of separation between the cutting head assembly and the material to be cut.

During the sharpening function, the blade has to exit the material and is released to ensure that the sharpening elements come into contact with the cutting edge thereof to thus interrupt the cutting function while the sharpening is performed. Said sharpening elements include, for example, flexible abrasive belts, active or passive grinding wheels, in different designs and abrasive materials, regardless of their arrangement.

The sharpening elements are often disposed in a predetermined fixed position on the cutting head, due to which the blade needs to rotate to find this sharpening position on one or both sides of the blade.

In other cases, the sharpening systems are rotary and inertial systems, due to which the blade is placed in a bi-directional rotary position when it exits the cutting material. In these cases, the abrasive elements remain suspended, and the entire lower body, along with the blade, rotates to allow inertial motion to put said abrasive elements in contact with the blade.

There are also other sharpening systems that rotate along with the blade, rather than having a predetermined fixed position. Thus, when blade exits the cutting area, it is sharpened without having to position itself for this purpose.

In these designs, the sharpening systems are situated on the lower body of the cutting head, either in the upper part (active sharpening systems) or in the lower rotary guide plate (passive sharpening systems).

In the active sharpening systems, the abrasive elements are in motion, and this movement results from an external mechanism activated by pulleys, pistons, electromagnets, etc., which transmit movement to these abrasive elements. Active sharpening provides the highest cutting quality.

There are also designs which provide passive sharpening mechanisms, i.e., the elements containing the abrasive material are not linked to any external movement. Their movement, in the case of mobile designs, comes from the friction between the blade and this sharpening element, usually grinding wheels in an arrangement that allows frictional rotation when both elements, grinding wheel and blade, come into contact.

Therefore, several conditions are required in order for the sharpening to be carried out: stopping the vectorial motion of the cutting machine, taking out the blade from the material being cut, contacting the sharpening element with the cutting element (blade), and a guiding system keeping the abrasive elements aligned with the blade.

These elements, in turn, determine the physical (cinematic) dimension and the productivity of cutting machines because the sharpening function is frequent and paramount. This dimension and weight affect the overall design of the machine: the performance of the motors, the strength of the supporting elements, maintenance costs, $CO_2$ load, manufacturing, transportation and installation costs, etc. throughout the product lifecycle.

The sharpening systems that are mounted on the lower rotary guide plate, which are integral to the guide systems, are advantageous because they need shorter blades, which in turn decrease bending and weight resulting in a better cut and less expensive replacements, and they are sharpened practically as soon as the blade exits the material to be cut, providing faster sharpening and therefore better productivity.

There are two variants in the systems that are mounted on the lower rotary guide plate: rotary systems that rotate in a manner integral to the guide of the blade, which allow the blade to be sharpened directly when exiting, and systems that are situated outside of the plate, which have a fixed position and do not rotate in a manner integral to the guide of the blade, due to which they require the blade to rotate towards the sharpening elements after exiting the cutting material.

There is no other system on the market that can be mounted on the rotary plate guide and that provides active sharpening, that is, while the abrasive elements move. Therefore, they are systems that provide enhanced sharpening and stand out from the others, since a sharp blade implies faster cutting, less friction and therefore less temperature. In short, a more precise and cleaner cut.

There are also no active sharpening systems mounted on the outside of the plate, although these are less efficient because the blade cannot exit the material and be sharpened while exiting in real time regardless of the position (angle) of the blade and the rotary guide located inside the guide plate. In this case, the blade has to first exit the cutting material, and then rotate the angle to the fixed position toward which the sharpening system is oriented.

Another drawback of current sharpening systems, regardless of their design, is that they have no control over the exact position of the abrasive elements relative to the blade during sharpening, when the blade starts to wear out. These systems are currently activated by means of mechanisms that comprise pistons, motors and springs that serve to either activate or damp the impact of the abrasive element on the blade.

In short, they are systems that can be adjusted but are not dynamic, since they do not adapt their position to the wear of the blade in a precise manner but do so in an approximate manner, as described: the abrasive element approaches until it collides with the blade, with more or less force.

In addition, current systems are not modular, due to which it is impossible to modify the type of abrasive element for each occasion, nor to have a specific design for supporting said abrasive element, adapted to every occasion. It is important to note that each material requires an abrasive element and a suitable profile to obtain the best performance and sharpening quality. This has an effect on the cutting quality and also on productivity and replacement costs, since the sharpening frequency and therefore, the durability of the grinding wheel and the blade, varies.

These elements determine the efficiency and cutting precision that are fundamental in this type of computer numerical control cutting equipment.

Therefore, an object of the present invention is to provide a sharpening system as an integral and simple solution to current sharpening systems, which makes it possible to incorporate an active sharpening system in the guide plate, either in the rotary area or on the outside, or symmetrically and interchangeably in the upper part of the lower body of the cutting head, as well as allowing the sharpening system to have a modular configuration for the abrasive elements based on application (abrasive drum (vacuum sharpening), disc (flat sharpening), abrasive belt, friction member, etc.), combining the two systems interchangeably and simultaneously such as: dynamic active rotary drum or disc systems or an active disc or drum system with a friction member or any combination of abrasive or sharpening elements.

DESCRIPTION OF THE INVENTION

The sharpening device of the invention resolves the drawbacks mentioned above and exhibits other advantages that will be described below.

The sharpening system for cutter blades for cutting flexible materials according to the present invention comprises a first sharpening module that includes at least one first sharpening element, and a second sharpening module that includes at least one second sharpening element.

According to a preferred embodiment, said first sharpening module comprises two first sharpening elements placed facing each other on both sides of the blade.

In addition, said first sharpening module also preferably comprises at least one lubricant applicator, which applies a layer of lubricant to the blade. According to one embodiment, said first module comprises two lubricant applicators, situated facing each other on both sides of the blade.

In the first sharpening module, said first sharpening element(s) is(are) movable and move toward and away from said blade, said sharpening element(s) being friction (passive) or motorised (active) elements, interchangeably.

On the other hand, according to a preferred embodiment, said second sharpening module comprises two second sharpening elements placed facing each other on both sides of the blade, and advantageously said second sharpening element (s) is(are) rotary around the central axis thereof.

According to a preferred embodiment, said two sharpening modules specialize in: a first passive sharpening module that operates by friction on the cutting edge of the blade, and a second motorised active sharpening or grinding module, which is highly precise due to its position near the area of the guide plate. Despite this preferred embodiment, two active grinding modules can also be used in different forms, including drum, belt, disc, etc.

Inside the cutting head, the sharpening system for cutter blades for cutting flexible materials according to the present invention is mounted on the lower part of the lower body of the head (on the rotary guide plate). Said lower plate comprises an outer disc and an inner disc that are mounted around the blade, the inner disc being mobile (rotary) with respect to said outer disc.

Preferably, said outer disc comprises electrical contacts complemented with conductive tracks of said inner disc, for actuating said sharpening elements and, in addition, the outer and inner discs comprise complementary sealing protrusions and recessions to insulate said electrical elements from environmental dust and dirt. These electrical contacts have actuators that make them move forward and backward, such that they are only in contact with the conductive tracks during sharpening, which makes it possible to avoid the wear caused by friction of such electrical elements during the rotary motion of the inner disc relative to the outer disc.

Advantageously, the inner disc is integral to the blade, and these electrical contacts power actuators of the at least one sharpening element and/or of the at least one second sharpening element, such that, when the blade is separated from the flexible material to be cut, said actuators are automatically activated to sharpen the blade by means of the first sharpening module and/or the second sharpening module or alternatively.

Alternatively, to electrically transmit both power and signal, a wireless system such as that described in Spanish Patent with application number 201830482, from the same inventor and owner, can be used. Said system described in the Spanish patent with application number 201830482 can replace or complement said tracks and conductive contacts.

The sharpening system according to the present invention provides an integral and simple solution to current sharpening systems and makes it possible to incorporate active sharpening systems in the rotary guide plate of a computer numerical control cutting machine, or symmetrically in the upper part of the lower body of the cutting head, interchangeably.

It also makes it possible to have a modular configuration for the abrasive elements based on application, such as an abrasive drum (vacuum sharpening), disc (flat sharpening), abrasive belt, friction member, etc., and is able to support different sharpening systems interchangeably that sharpen in combination or in an alternative manner as needed for each flexible material to be cut.

As the abrasive elements are mounted on a disc that move in a manner integral to the blade, the direct abrasive elements are easy to actuate and move.

In addition, the sharpening system according to the present invention consists of very few elements, freeing up space and simplifying movements and actuation, which makes it possible to have more complex functions in less space and with fewer components.

With the system according to the present invention, these abrasive and sharpening elements can move toward the blade in a controlled and smooth manner (controlling position and approach), since the pressure and position can be modified for the different steps of use of the blade and, therefore, depending on wear and the type of sharpening.

BRIEF DESCRIPTION OF THE DRAWINGS

To aid a better understanding of the above, drawings have been attached, in which a practical embodiment has been schematically represented and only by way of a non-limiting example.

DESCRIPTION OF A PREFERRED EMBODIMENT

Figure 1:
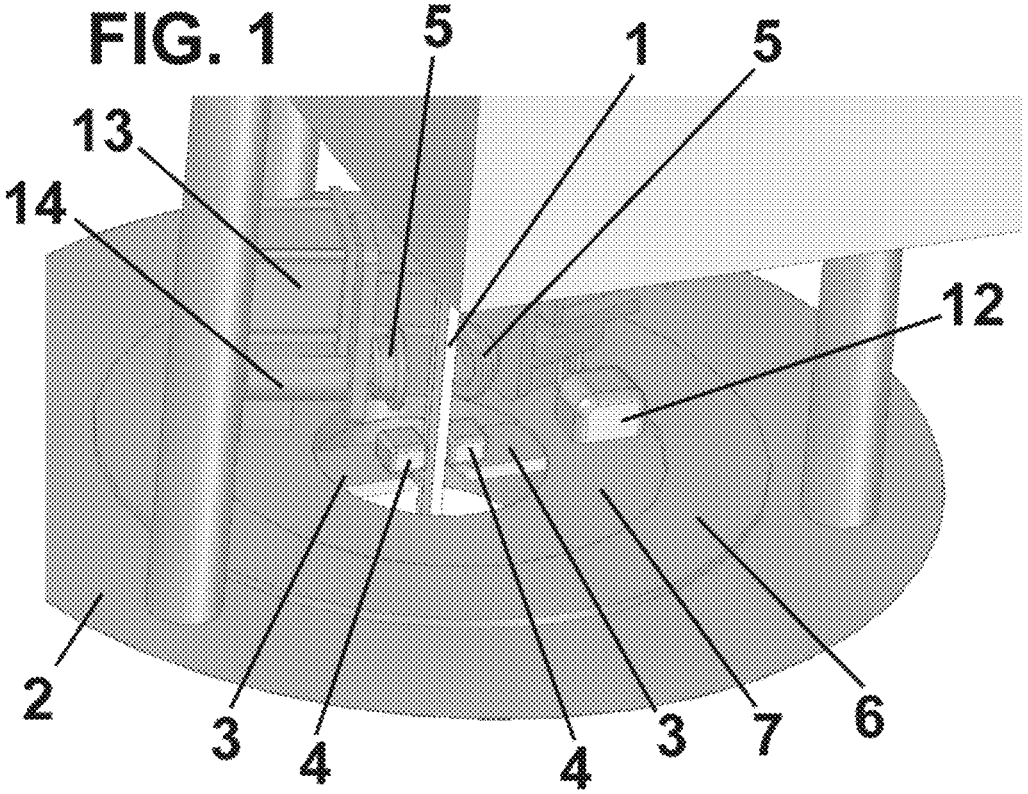
FIG. 1 is a first perspective view of the sharpening system according to the present invention.

The sharpening system according to the present invention is used to sharpen the blades of cutting machines for cutting flexible materials, such as fabric or the like.

Said cutting machine comprises a blade 1 that cuts the flexible materials and a guide plate 2, which presses against the flexible material to be cut at the time of cutting.

Said guide plate 2 consists of an outer disc 6 and an inner disc 7, said inner disc being 7 mobile with respect to said outer disc 6. The inner disc 7 is integral to the blade, rotating at the same time as the blade, while the outer disc 6 is static and integral to the guide plate 2.

The sharpening system according to the present invention comprises two separate sharpening modules: a first passive sharpening module that operates by friction on the cutting edge of the blade 1, and a second sharpening module that performs high-precision motorised active sharpening or grinding.

The first sharpening module shaves the cutting edge at the tip of the blade 1 to provide high-quality sharpening without causing wear on the blade 1. It requires little time since it is done when the blade 1 exits the guide plate 2 and the cut material.

This first sharpening module comprises at least one first sharpening element 3, two first sharpening elements 3 in the case of the embodiment representing the same facing each other on each side of the blade 1, and works by friction between the cutting edge of the blade 1 and this passive sharpening element 3, which is harder than the blade 1.

Said sharpening elements 3 can move toward and away from the blade 1. Thus, in a single movement of the blade 1 into and out of the cutting material, the sharpening element(s) renew(s) the cutting edge of the blade 1.

In addition, the first sharpening module can comprise lubricant applicators 4 to apply lubricant to the blade 1, impregnating it with a very thin layer of lubricant, to enhance cutting. Said layer of lubricant should not be too thick, since in this case it could stain the cut material.

Figure 2:
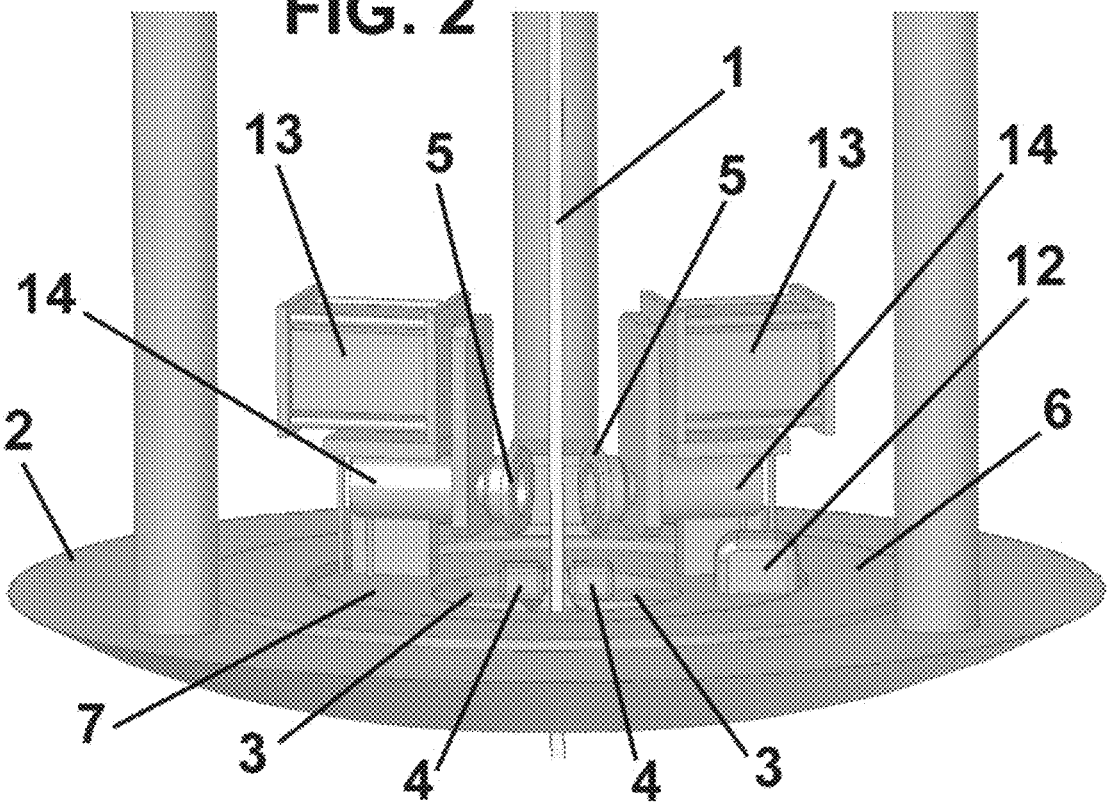
FIG. 2 is a second perspective view of the sharpening system according to the present invention.

The first sharpening elements 3 and the lubricant applicators 4 are actuated by first actuators 12, shown in FIGS. 1 and 2.

Figure 3:
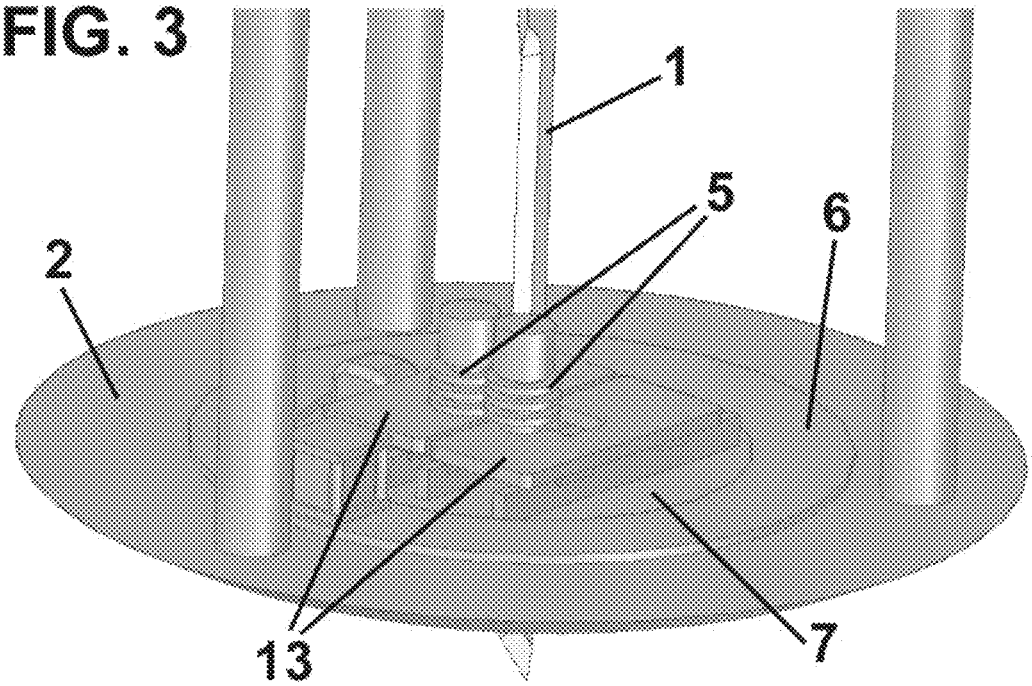
FIG. 3 is a perspective view of the sharpening system according to the present invention, showing a second embodiment of the second sharpening module.

On the other hand, the second sharpening module provides high-speed modular active sharpening, comprising at least one second sharpening element 5, two second sharpening elements 5 in the case of the represented embodiment which makes it possible to exchange the second sharpening element 5 as appropriate for the application, shown in FIGS. 2 and 3. In addition, it comprises a separate approach system for each second sharpening element 5 with dynamic position control, consisting of second actuators 13.

In addition, this second sharpening module also comprises third actuators 14 to actuate the rotation of said second sharpening elements 5 around the central axis thereof.

Figure 4:
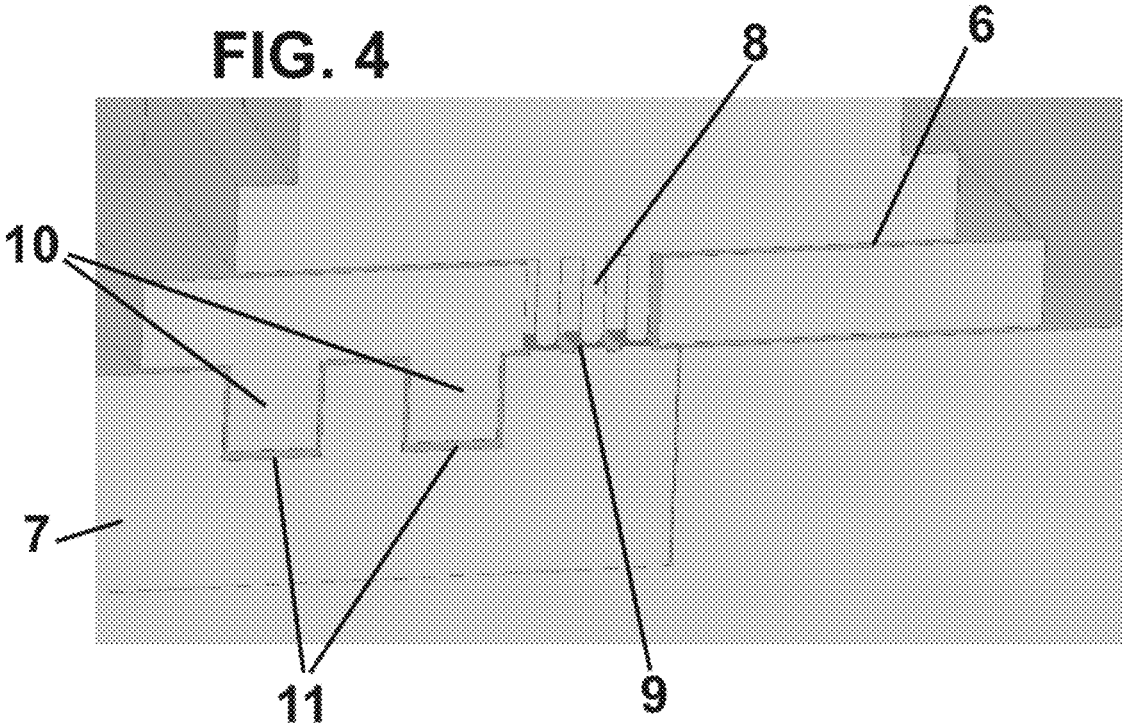
FIG. 4 is a sectional view between the inner and outer discs, showing the electrical contacts, the conductive tracks, the sealing protrusions and the sealing recessions.

As shown in FIG. 4, the inner disc 7 has circular conductive tracks 9 complemented with electrical contacts 8 on the outer disc 6, which make it possible to electrically activate and control the actuators 12, 13, 14 or others, preferably situated on the inner disc 7, resulting in the activation of the different actuators and the transmission of the signal. It also makes it possible to transmit power and signal to other sensors that are situated on the inner disc 7.

In addition, to ensure insulation, the outer disc 6 and the inner disc 7 comprise complementary sealing protrusions and recessions 10, 11, as shown in FIG. 4.

The operation of the first and/or second sharpening modules is performed when the cutting head of the cutting machine stops the cut, that is, when the circular, rotary motion of the blade 1 is stopped, usually but not necessarily, for the purpose of sharpening the blade. Since said first and second sharpening modules are on the inner disc 7, they are integral to the rotary motion of the blade 1, such that they are always positioned in the direction of the blade 1 while exiting the cutting area.

Thus, when the blade 1 starts to exit the material being cut, the conductive tracks 9 of the inner disc 7 come into contact with the electrical contacts 8 of the outer disc 6, which activates the actuators 12, 13, 14 automatically, preventing unnecessary movements and non-productive periods.

Although reference has been made to a specific embodiment of the invention, it is obvious to a person skilled in the art that the sharpening system described is subject to numerous variations and modifications, and that all the details mentioned can be replaced by other technically equivalent ones, without departing from the scope of protection defined by the claims attached hereto.

The invention claimed is:

1. A modular sharpening system for a cutter blade for cutting flexible materials mounted in an automatic cutting machine, comprising a blade and at least one sharpening element that can move toward the blade, a pressure and a position being modified depending on wear and type of sharpening, comprising a first sharpening module that includes at least one first sharpening element, and a second sharpening module that includes at least one second sharpening element, characterized in that the sharpening system comprises a guide plate consisting of an outer disc and an inner disc that are mounted around the blade, said first and second sharpening modules being on the inner disc, being integral to the rotary motion of the blade, rotating at the same time as the blade.

2. The sharpening system according to claim 1, wherein said first sharpening module comprises two first sharpening elements placed facing each other on both sides of the blade.

3. The sharpening system according to claim 2, wherein said first sharpening element(s) and said second sharpening element(s) are chosen from the group of friction members, rotary disc, rotary drum and abrasive belt.

4. The sharpening system according to claim 1, wherein said first sharpening module also comprises at least one lubricant applicator, which applies a layer of lubricant to the blade.

5. The sharpening system according to claim 4, wherein said first sharpening module comprises two lubricant applicators, situated facing each other on both sides of the blade.

6. The sharpening system according to claim 1, wherein said first sharpening element(s) is(are) movable and move toward and away from said blade.

7. The sharpening system according to claim 6, comprising a position control to move the first and second sharpening elements forward.

8. The sharpening system according to claim 1, wherein said second sharpening module comprises two second sharpening elements placed facing each other on both sides of the blade.

9. The sharpening system according to claim 1, wherein said second sharpening element(s) is(are) rotary around the central axis thereof.

10. The sharpening system according to claim 1, wherein said second sharpening element(s) is(are) movable and move toward and away from said blade.

11. The sharpening system according to claim 1, wherein said inner disc is mobile with respect to said outer disc.

12. The sharpening system according to claim 1, wherein said outer disc comprises electrical contacts complemented with conductive tracks of said inner disc, for actuating said sharpening elements.

13. The sharpening system according to claim 12, wherein said electrical contacts power actuators of the at least one first sharpening element and/or of the at least one second sharpening element.

14. The sharpening system according to claim 1, wherein the outer and inner discs comprise complementary sealing protrusions and recessions.

* * * * *